United States Patent [19]

Hiller

[11] 4,339,072

[45] Jul. 13, 1982

[54] CENTRIFUGE FOR SEPARATING SOLIDS/LIQUIDS MIXTURES

[75] Inventor: Georg Hiller, Vilsbiburg, Fed. Rep. of Germany

[73] Assignee: Klöckner-Humboldt-Deutz AG, Fed. Rep. of Germany

[21] Appl. No.: 197,943

[22] Filed: Oct. 17, 1980

[30] Foreign Application Priority Data

Oct. 20, 1979 [DE] Fed. Rep. of Germany ..... 2942451
Sep. 27, 1980 [DE] Fed. Rep. of Germany ..... 3036550

[51] Int. Cl.[3] ..... B04B 1/20

[52] U.S. Cl. ..... 233/7; 233/20 R; 233/23 R; 233/47 R; 233/31

[58] Field of Search ..... 233/7, 19 R, 19 A, 31, 233/20 R, 20 A, 23 R, 24, 27, 28, 29, 32, 34, 35, 40, 41, 44, 46, 47 R; 210/360.2, 369, 360

[56] References Cited

U.S. PATENT DOCUMENTS 2,184,598 12/1939 Jahn ..... 233/47
3,836,070 9/1974 Trawinski ..... 233/7
3,858,794 1/1975 Nilson ..... 233/20 R
4,190,194 2/1980 Amero ..... 233/47 R

OTHER PUBLICATIONS

KHD-Humboldt Wedag Brochure 5-350, published Jun., 1978.

*Primary Examiner*—Robert W. Jenkins
*Attorney, Agent, or Firm*—Hill, Van Santen, Steadman, Chiara & Simpson

[57] ABSTRACT

A centrifuge is disclosed designed either as a solid bowl centrifuge or separator for separating solids/liquids mixtures. A centrifuge drum having an outer jacket is provided with apertures positioned in the jacket. Through the apertures at least a partial discharge of concentrated solids phase occurs thereto. A control device preferably in the form of a disk provides a surface spaced at a small interval from the apertures so as to prevent the flow of solids/liquids through the aperture except when a discontinuity such as a recess or cut-out in the surface occurs so as to allow flow through the aperture.

39 Claims, 14 Drawing Figures

CENTRIFUGE FOR SEPARATING SOLIDS/LIQUIDS MIXTURES

BACKGROUND OF THE INVENTION

The invention relates to a centrifuge for separating solids/liquids mixtures in which at least one concentrated solids phase is at least partially discharged through at least one aperture arranged below the liquid level in the jacket of the drum and which exhibits at least one control device for opening or closing this aperture.

A known centrifuge of this type has nozzles on the circumference of the drum with control devices for opening or closing these nozzles. The control devices are automatically functioning valves which can be actuated by the pressure in the concentrated solids phase and permit automatic bleeding of the solids phase from the centrifuge. See German AS No. 1,482,708 incorporated herein by reference.

It is a disadvantage if the control devices are designed in valve-like fashion and consist of complicated fine-mechanical parts constructed with great precision whose sensitivity and susceptibility to disruption is not suitable for the rugged operation of a centrifuge.

In particular, it can not be guaranteed that the valves distributed over the circumference suddenly open at the same time. If this does not occur, however, the centrifuge is brought out of balance due to the one-sided discharge, which can lead to considerable disruptions including damage to the machine.

Another known solid-bowl centrifuge (German AS No. 2,063,063 corresponding to U.S. Pat. No. 3,836,070 incorporated herein by reference) with slurry discharge apertures in the jacket, has means for opening and closing these apertures which are actuated by use of a jolt-like deceleration or acceleration of the centrifuge. In this known centrifuge, the complicated and involved mechanism for opening and closing the slurry discharge apertures is likewise a disadvantage. Even more questionable, however, are the deceleration or acceleration jerks required for actuation of the control devices, the employment of such jerks being practically prohibitive, particularly given larger machines with accordingly higher forces of gravity. Of course, this technique also has a disadvantageous influence on the machine itself as well as its contents.

SUMMARY OF THE INVENTION

An object of the invention is to provide a centrifuge of the above described type in which the control device for opening and closing the apertures arranged in the jacket of the drum is as uncomplicated as possible and, in particular, requires no mechanical parts which must be manufactured with precision.

Another object of the invention is to provide the ability to adjust the actuation of the control device in such a sensitive fashion that thickened or concentrated solids/liquids mixtures can be controlled according to the value of operating parameters governed by control engineering, can be bled in controlled amounts and/or amounts per time unit and, in particular, can be discharged without jerky accelerations.

It is a further object of the invention to keep the function of the control device free of the influence and/or size of the artificial gravitational field.

Finally, the invention device should be low-wear, easy to service, and preferably actuatable with a simple operating unit, for example with remote control at an operating console.

In the invention the control device is equipped with a drive. A drive is defined herein as any energy delivery point at the input of a machine or of a power train, or, respectively, of a mechanism, whereby this is part of a machine or machine installation which conveys a motion to this and feeds the mechanical energy required from the exterior.

According to this definition, the inventive control device essentially consists of a functionally integrated part of a machine installation which renders possible the arbitrary actuation from the outside by means of feeding mechanical energy in a simple manner, for example via a gear or power train.

As a result, the advantage arises with the invention that the control device is functionally governable and can be actuated, for example, by means of a gear or power train, and a dependence on operating states such as pressures, or jerky accelerations is avoided in a simple manner.

In a development of the invention, the control device is arranged rotatably in relationship to the drum and is connected to the drum via the drive. By so doing, there arises the advantage that the control device can be constructed in an uncomplicated and rugged fashion, and therefore is also insensitive to disruptions.

A further development provides that the control device is driven with a differential speed to the drum. The differential speed can be changeably set, for example, from zero up to the drum speed.

By so doing, the advantage results that the discharge of the thickened or concentrated solids phase can be set as desired and thereby optimized.

With the invention, a dependency of the discharge to the remaining operating conditions or operating parameters does not result in contrast to the prior art. Previous technology limits are now expanded and considerable progress has been achieved with this invention.

In a development of the invention the control device is in an effective or active connection to the aperture, whereby this can be expediently designed in such manner that, given a relative motion with respect to the drum jacket, it alternately covers or uncovers the opening.

For this purpose the control device can be designed in such manner that it has a width at least partially covering the aperture.

If, for example, the control device is in effective interaction with the aperture, and which has a width at certain locations at which the aperture is only partially covered, then this does not produce a closure of the aperture, but an increase of the flow resistance and thus a reduction of the amount of slurry emerging per time unit. On the other hand, given a width portion covering the aperture in an effective interaction of the control device with the aperture, the flow of the slurry through the aperture is interrupted. Accordingly, a complete contact closure need not absolutely exist between the control element and the aperture.

Coverage of the aperture at a defined gap or interval suffices for arresting the flow of a thick-matter fluid, particularly with thixotropic properties.

In a further development of the invention the control devices in its closing position is at an interval from the aperture so as to create a gap with labyrinth effect, and that the interval between the aperture and the control device is preferably adjustable.

By means of this invention, a particularly uncomplicated and rugged design for the control device results which, above all, is not susceptible to wear and which, while eliminating all physical contact in the closing state, is superior to all complicated mechanical control devices. Thereby, it has surprisingly occurred that the closing effect is present given aqueous solids mixtures even at high and extremely high centrifugal accelerations. This effect is presumably based on a favorable effect of the wall friction of minute solids particles.

With the invention the control device can be arranged both inside as well as outside the drum.

Given a control device arranged within the drum, this control device has a dish-like design and has at least one recess and/or a preferably cam-like projection in the area interacting with the aperture.

All such developments of the control device function in the same manner such that, in interaction with the aperture, they produce the function of a spool valve.

Preferably the control device is a retarding disk which preferably covers the aperture with an edge area. Therefore the retarding disk, for example, can be arranged on the worm body of a discharge worm and the spiral can be conducted through a recess of the retarding disk.

In a development of the control device it is designed as a rotary valve.

If, in addition to a slurry-like fluid solids phase, a solids phase permeated with coarser solids particles exists, this phase generally being discharged from the centrifuge drum with a worm discharge element, then it is advantageous if the control device is equipped with a device for keeping the aperture clean or clear, preferably with an elastic stripper.

A further development of the invention is the interaction with the aperture and control device wherein the aperture is arranged in a nozzle body which can preferably be screwed into the drum jacket from the outside.

In a form of the invention the aperture of the nozzle body can be changed in cross-section and is preferably formed by means of inserts consisting of elastic, wear-resistant material.

DESCRIPTION OF THE PREFERRED EMBODIMENTS

Figures 1, 1A, 1B, 1C:
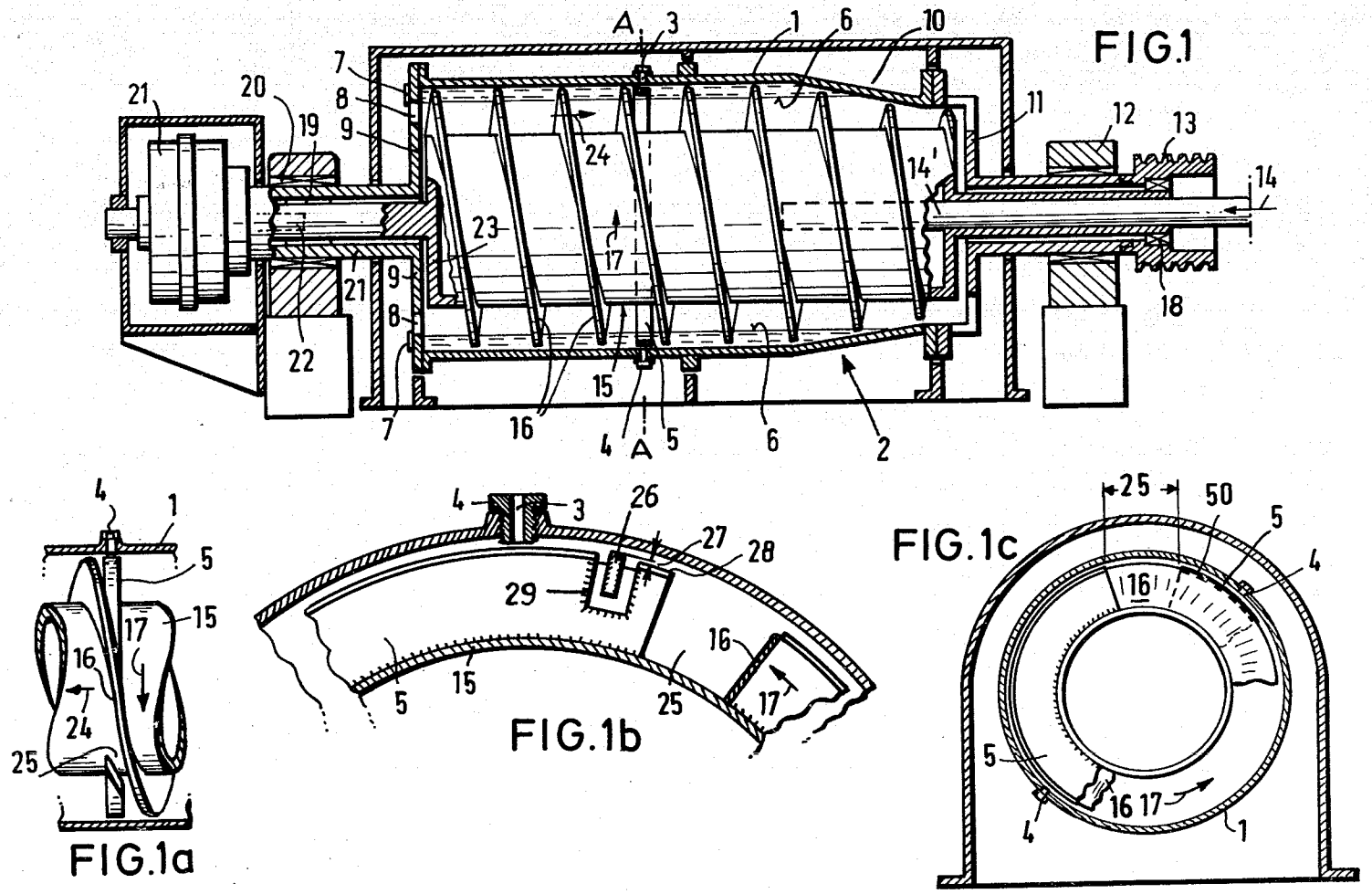
FIG. 1 is a cross-sectional view of a centrifuge according to the invention.
FIG. 1*a* is an enlarged detail in partial cross-section and partial elevation of the centrifuge according to FIG. 1.
FIG. 1*b* is an enlarged detail view of the centrifuge according to FIG. 1 with the control device and an elastic stripper.
FIG. 1*c* is a sectional view through the centrifuge according to FIG. 1 in a section plane perpendicular to the axis of rotation.
Figure 2:
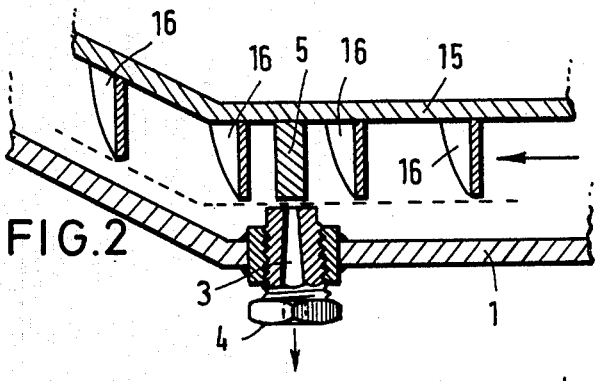
FIGS. 2 through 6 are detailed illustrations of the control device interacting with a nozzle-like aperture.

In FIG. 1, the drum 1 of the solid-bowl worm centrifuge 2 is equipped at its circumference with a plurality of discharge apertures 3. These are arranged in nozzle-like bodies 4 as shown in the enlarged and detailed illustration in FIGS. 2 through 6. Identical parts in these figures are provided with the same reference numbers. In the position illustrated, these apertures 3 are covered by the control element 5 and are closed in this manner, whereby the flow of the concentrated slurry phase is prevented. As known, this slurry phase sediments at the lowest point of the clarification basin banked in the inside of the drum 1. The level 6 of this clarifying basin is determined by the weirs 7 which are adjustable in height. These are situated at the apertures 8 of the closing plate 9 at the end face of the drum 1 provided for overflow of the concentrated slurry phase or centrate. This drum 1, moreover, is supported at its conically tapering side 10 by a supporting structure and mounting 11 which is in turn rotatably seated in the bearing device 12. The drive of the drum ensues via the V-belt pulley 13 by means of a V-belt transmission not illustrated in greater detail and by means of a motor, likewise not illustrated. The input of the suspension, as indicated by the arrow 14, ensues through a charging pipe 15 into the inside of the centrifuge 2.

The basic function and fundamental structure of the centrifuge is of course well known to one skilled in the art. The centrifuge 2 has a rotatably seated worm body 15 which carries the spirals 16. The direction of movement of the worm body 15 is indicated by arrow 17. The worm body 15 is rotatably seated within the drum 1 by means of the intermediate bearings 18 and 19. The rotational motion imparted to the drum 1 via the V-pulley drive 13 is transmitted via the end plate 9 to a hollow shaft 21 seated in the bearing member 20 and is transmitted from hollow shaft 21 to a differential gear 21 which is in turn rigidly connected on the output side to the left-hand end plate 23 of the worm body 15 by the shaft 22. When rotating in the direction of arrow 17, the spirals 16 transport sedimented solids in the direction of arrow 24. In order to prevent the disk-shaped control element 5 from blocking the transport of the solids, the spiral 16—in accordance with a detailed illustration in FIG. 1*a*—is positioned through a recess 25 of the control element 5.

FIG. 1*b* shows the arrangement of spiral 16 and control disk 5 in section along the plane A—A in FIG. 1. The illustration according to FIG. 1*b* shows the worm element 15 in cross-section with the spiral 16 likewise in cross-section, as well as the disk-like control device 5 in elevation. As already described above, the nozzle body 4 with the aperture 3 is screwed into the drum jacket 1 from the outside. The recess 25 is situated in the control device 5, through which recess—perpendicular to the plane of the drawing—solids are transported through the spiral 16. Further, the control device 5 is equipped with a rubber-elastic stripping element 26 which projects beyond the periphery 28 of the control element 5 by the amount 27. This stripping element 26 is secured in a seat 29.

The functional relationship of a control device 5 and a spiral 16 is further illustrated in cross-section according to FIG. 1*c*. It can there be seen that the spiral 16 passes through the recess 25 of the control element 5, whereby, except for its edge section 50, the control disk 5 visually recedes to the right of the recess 25, since it is covered to the eye of the observer by the spiral 16. On the other hand, the spiral 16 undercutting at an angle behind the control disk 5 to the left of the recess 25 is optically hidden to the eye of the observer by this control disk 5. Given rotation of the spiral 16 in the direction of arrow 17, solids are transported from the plane of the drawing in the direction towards the observer.

Further particulars concerning the interaction of a control device 5 with an aperture 3 can be derived from the detailed illustrations in FIGS. 2 through 6. According to FIG. 2, the worm body 15 is equipped with spirals 16 and, further, with the control element 5. In the present case, this is a disk-shaped element which has a width which covers the aperture 3. Accordingly, the control function can be produced either by recesses in the width or recesses in the diameter. The arrangement and design of these recesses, however, is subject to the mechanical dexterity of one skilled in the art and, therefore, not illustrated in greater detail in FIG. 2.

Figure 3:
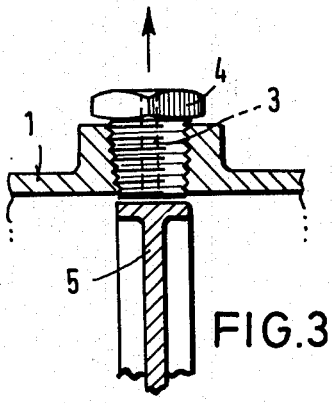
Figure 4:
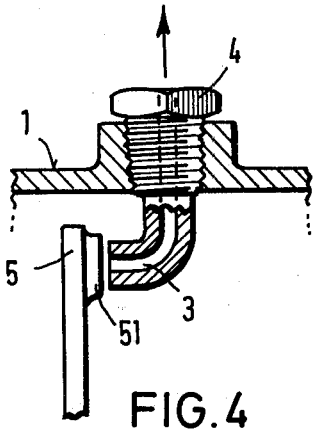
Figure 6:
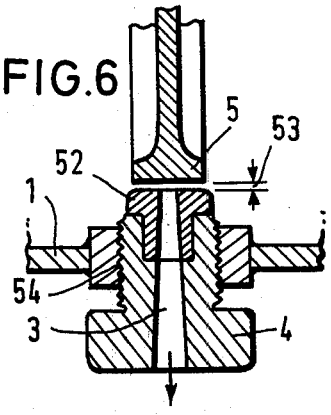

A design of the control device 5 with a T-shaped cross-section can be seen in FIG. 3. Another embodiment according to FIG. 4 reveals a U-shaped aperture 3 bent in the direction of flow interacting with the disk-shaped control device 5. In the example illustrated, the latter have control cams 51 applied to their end faces. These control cams 51 close the discharge aperture 3 when overlapping and open it in the release position. FIG. 6 shows a nozzle body 4 containing the aperture 3 equipped with a wear-resistant insert 52. In the example illustrated, the control device 5 is a disk with a T-shaped cross-section.

Figure 5:
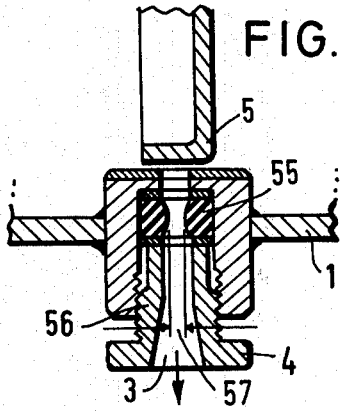

The interval between the control device 5 and the wear-resistant insert 51 is referred with the number 53. This interval can be varied as desired by changing the depth to which the body 4 is screwed into the thread 54. In the practical case, the gap width 53, for example, amounts to between 20 and 500 microns. FIG. 5 shows a somewhat different embodiment with an L-shaped cross-section of the control device 5. Accordingly, the nozzle element 4 has an elastic insert 55 changeable in cross-section which can be changed in diameter 57 within relatively wide limits depending on the depth to which the screw 56 is screwed in.

The function of the inventive device according to FIGS. 1 through 6 is as follows:

When the centrifuge 2 is placed in rotation, its drive, occurring with the assistance of pulley 13 via a V-pulley drive with corresponding drive motor (not illustrated), the drum 1 designed as a solid-bowl rotates with a differential velocity with respect to the worm element 15 likewise placed in rotation in the direction of arrow 17. The two rotating bodies 1 and 15 are indirectly connected to one another via the hollow shaft 21 and the shaft 22 as well as the differential gear 21. The differential gear 21 allows a differential velocity between the drum 1 and the worm element 15 to be adjusted by mechanical, electrical or hydraulic adjustment operations, the amount of said adjustment being variable as desired. Accordingly, the differential velocity in the extreme cases can be zero revolutions per minute on the one hand, and, on the other hand the speed of the drum jacket 1 given zero velocity of the worm element. In practical operation, the RPM difference amounts to between 2 and 10 revolutions per minute.

Given such an RPM differential, the control device 5 rotates with a relative velocity with respect to the drum jacket 1 and moves with its edge section 50 past the nozzle elements 4 accepting the openings 3. As already explained, a gap width in the magnitude of, for example, 20 to 500 microns thereby results in the coverage state, i.e., in the closed state. When, given a relative motion with respect to the drum 1, the control device 5 reaches one of the apertures 3 with its recess 25, the closed state is terminated and the aperture 3 is opened. At this moment, concentrated slurry is ejected through the aperture 3 in a controllable amount per time unit derived from aperture diameter, hydrostatic pressure, and viscosity. After a time deriving from the dimensions of the recess 25 and the relative velocity, the closed state between the control element 5 and the aperture 3 is again produced upon continuation of the relative motion, whereby the interplay of opening and closing is periodically repeated.

A control engineering influence on the slurry amount emerging per time unit is thereby possible, on the one hand, due to the type and design of the control element and the differential velocity as well as, on the other hand, due to a randomly variable plurality of apertures 3 on the circumference of the drum jacket 1, as well as due to a variable selection of the diameter 57 of each of these apertures 3.

Figure 7:
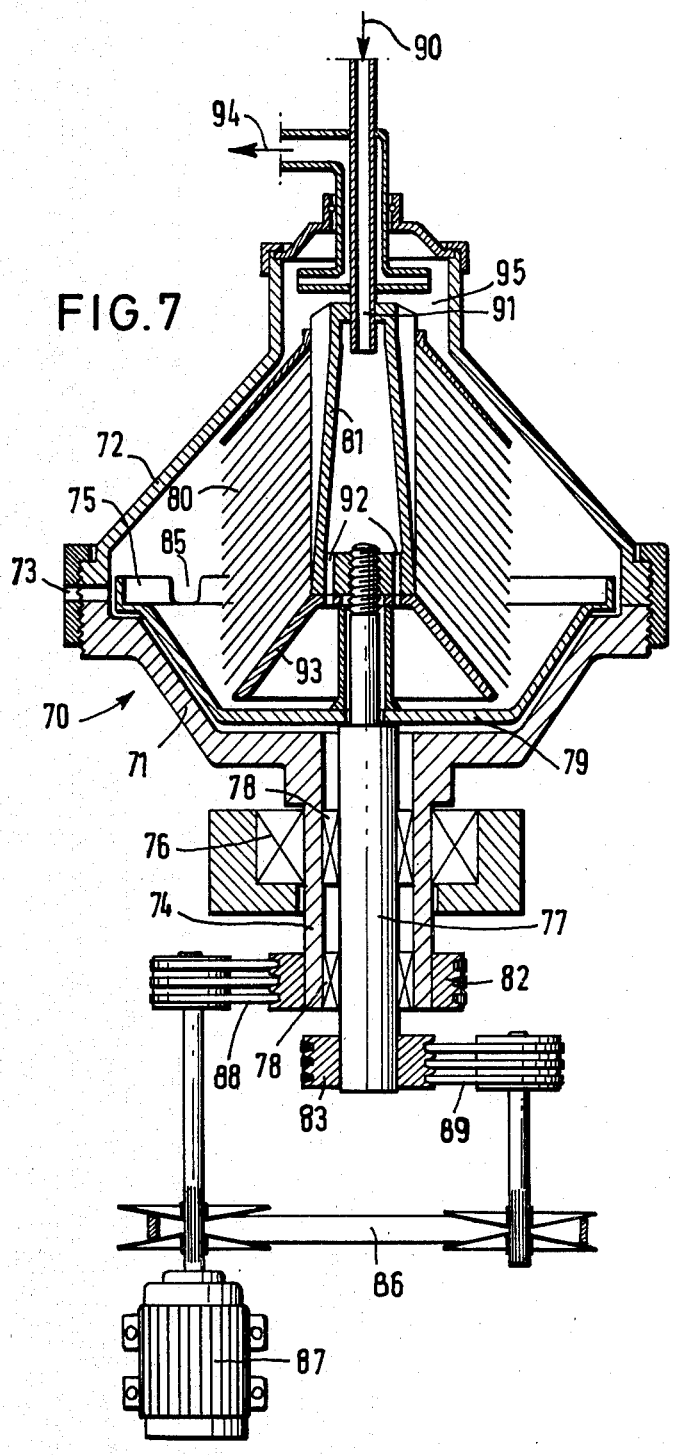
FIG. 7 is a cross-sectional view of a nozzle separator-type centrifuge equipped with the invention.

FIG. 7 shows an arrangement of the control device according to the invention in a separator type centrifuge.

The housing 70 of the separator consists, in a manner known per se, of the two housing portions 71 and 72 screwed to one another. Nozzle-like apertures 73 are arranged in the area of the greatest diameter, these nozzles rendering possible a free passage of the heavy slurry phase. In order to control this passage, the control element 75 designed according to the invention is shown in the example illustrated, this control element 75 is placed in rotation with a differential velocity in relationship to the housing 70. For this purpose, on the one hand the housing 70 with the hollow shaft 74 is rotatably seated in the bearing 76 and, on the other hand, the inside parts of the separator are rotatably seated on the shaft 77 independently of the housing 70. The shaft 77 and the hollow shaft 74 are seated inside one another by means of needle bearings 78.

The control device 75 is arranged in brackets 79 which are in turn rigidly connected to the shaft 77. Likewise, the body 81 carrying the separator plate 80 is rigidly screwed to the shaft 77 and rotates—in connection with the control device 75 on the same shaft—with differential velocity with respect to the housing 70. In the position illustrated, the control device 75 covers the aperture 73 and closes it in the manner already described. However, if as a result of the relative motion, the recess 85 migrates past the aperture 73, this is briefly opened and the collected slurry can emerge from the housing 70.

For the purpose of relative motion, both the hollow shaft 74 as well as shaft 77 are respectively equipped with separate sheaves 82 and 83. These are driven by a variable gear 86 and motor 87 with an adjustable velocity difference via the V-belt transmissions 88 and 89.

The input of the sludge ensues in a manner known per se in accord with arrow 90 through the delivery pipe 91 into the interior of the body 81 carrying the separator plates or disks 80, the suspension being conducted toward the bottom along this body's conically expanded wall and arriving through the apertures 92 into the conically expanded manifold 93 from where the suspensions arrive in a manner known per se into the separating space of the centrifugal separator. Whereas the settling slurry phase containing heavier solids is withdrawn through the discharge nozzles 73 in a controlled amount due to the control device 75 arranged according to the invention, the lighter phase in the upper area of the separator arrives in the discharge chamber 93 and, from there, into the discharge pipe 94.

In the present example also, the slurry amount discharged per time unit is adjusted, on the one hand, by the plurality and size of the apertures 73 at the diameter of the centrifugal separator housing 70 and, on the other hand, is governed by the differential velocity by the type and design of the control device 75 as well as its recesses 85.

Figure 8:
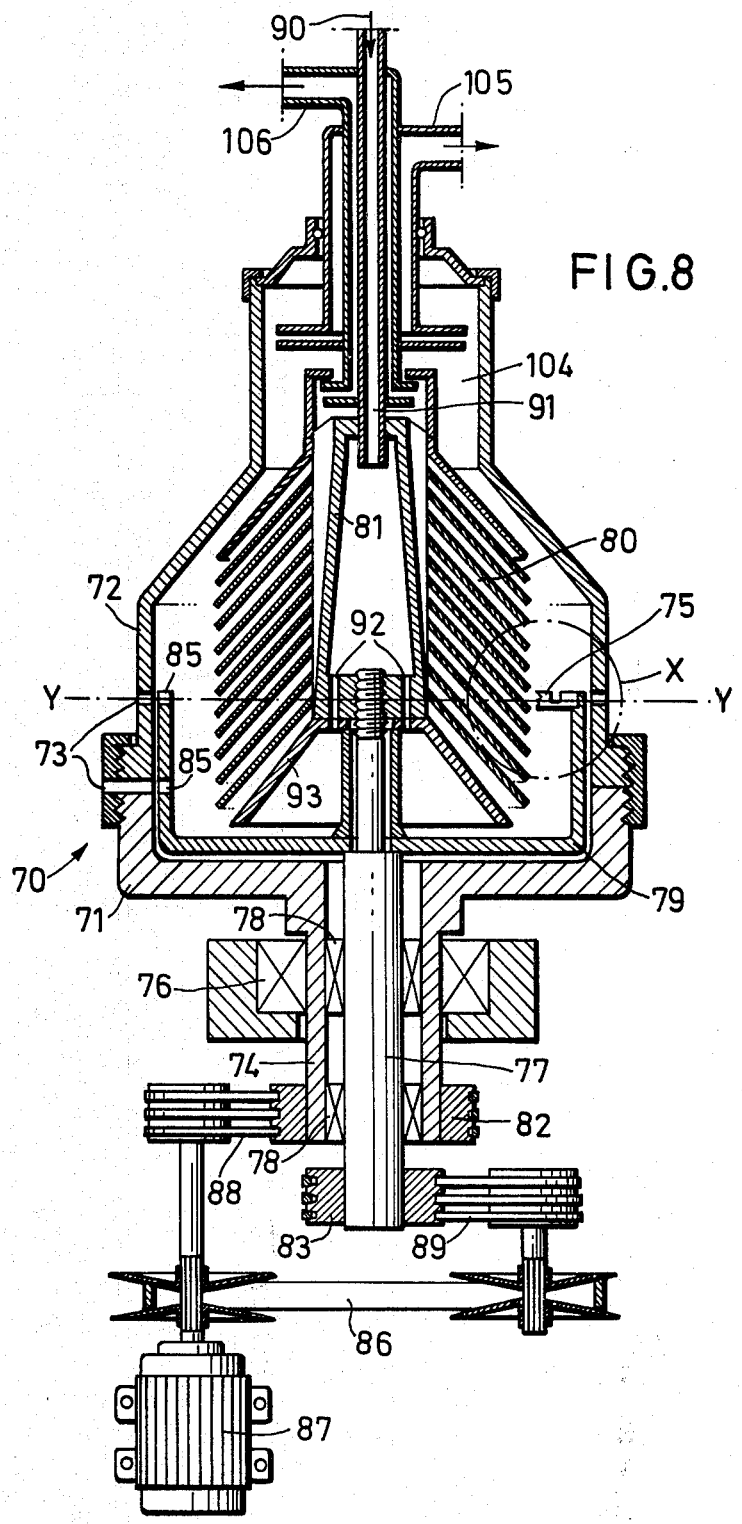
FIG. 8 is a cross-sectional view of another separator-type centrifuge similar to FIG. 7 equipped with the invention for separating three different phases.

FIG. 8 shows the control device according to the invention in another separator type centrifuge somewhat similar to FIG. 7 and with some common reference numerals in which three phases of solids/liquids mixtures with the phases having different weights and/or the mixtures of liquids being of differing densities can be separated from one another. The cylindrical housing 70 of the centrifuge consists of the two housing parts 71 and 72 which are screwed to one another. Several nozzle-like apertures 73 are arranged distributed on the housing 70 in the area of the greatest diameter, said apertures 73 making free passage of the heavy phase possible. In addition to the control device 75, the centrifuge also exhibits special built-in members 80 which serve to increase the separation effect.

The control, as described on the basis of FIG. 7 ensues by means of one or more control elements 75 which are arranged in brackets 79. Thereby, according to the invention the control of the individual nozzle-like apertures 73 can ensue independently of one another by setting different relative velocities with respect to the housing 70.

The input of the three-phase mixture ensues in a known manner in accordance with the arrow 30 through the delivery pipe 91 into the interior of the built-in member 80 designed as a dish packet and carried by the body 81. The suspension is conducted toward the bottom at the conically expanded wall of body 81 and arrives through the apertures 92 into the conically expanded manifold 93. The three phases arrive in a manner known per se into the separating space of the centrifuge. The settling phase containing the heaviest solids is withdrawn in a controlled amount through the discharge nozzles 73 by means of the control device 75 disposed according to the invention. The phase of moderate weight arrives into a discharge chamber 104 and moves from there into the discharge pipe 105. The light phase rises between the dishes 97 of the dish packet 80 and is withdrawn via the discharge pipe 106.

Figure 9:
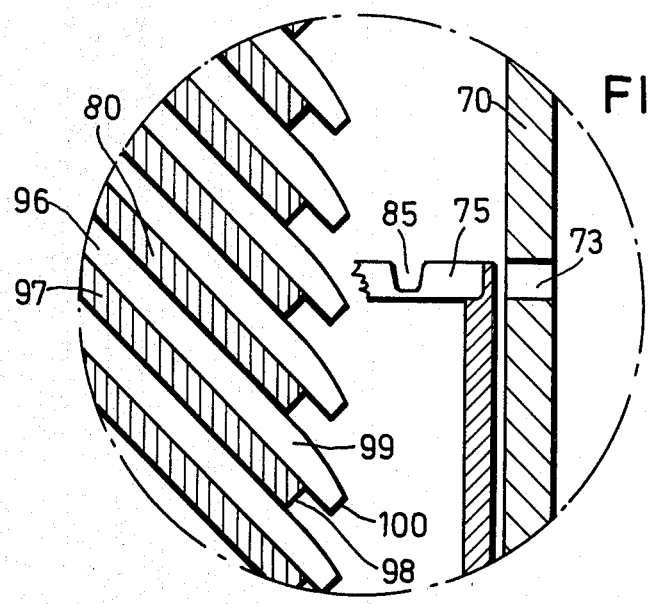
FIG. 9 is an enlarged detailed drawing of section X from FIG. 8, partially in section, partially in elevation.
Figure 10:
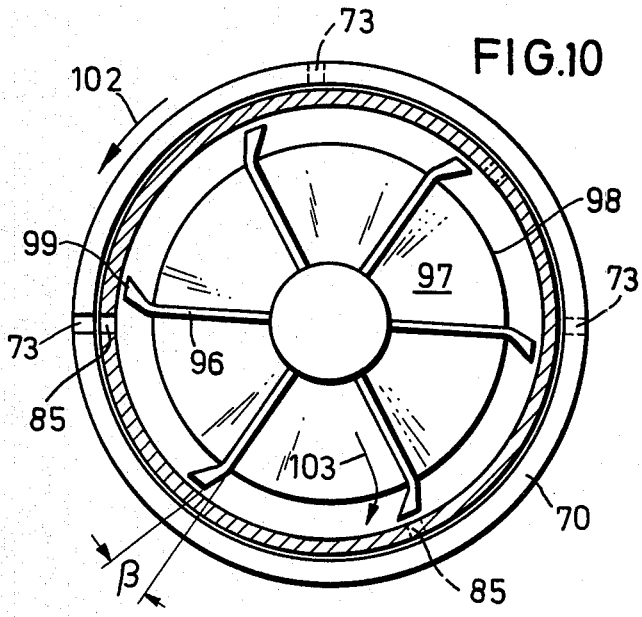
FIG. 10 is a view according to section Y—Y through the centrifuge shown in FIG. 8 in a sectional plane perpendicular to the axis of rotation.
Figure 11:
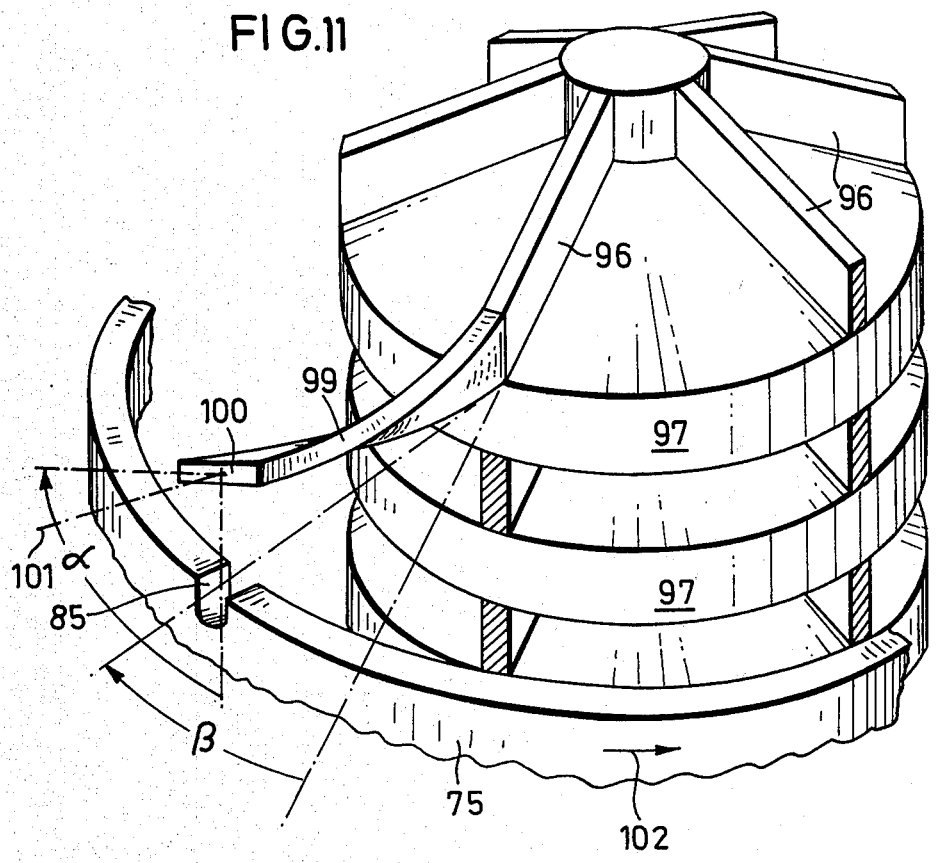
FIG. 11 is a perspective side view of the built-in units of the centrifuge according to FIG. 8.

FIGS. 9, 10 and 11 show the design of the dish inserts 80 in detail sections, given a design of the inventive device with a cylindrical jacket. To insure that the heavy phase which leaves the dish packet 80 in the direction 103 toward the outside jacket 70 as a result of centrifugal and inertial forces, receives a motion component parallel to the axis of rotation, deflection elements 99 are provided, for example, by extending the spacers 96 between the individual dishes 97 beyond the ends 98 of the dishes. By means of bending the deflection elements 99 in a suitable manner, it is possible for the heavier phase to move in the direction toward the nearest discharge nozzle 73.

To this end, as FIG. 11 shows, the end 100 of the deflection elements 99 is rotated around their center of gravity axes 101 in the rotational direction 102 by an angle alpha $\alpha$ between 0° through 90°, preferably 60°. The deflection elements 99 are bent down in the streaming direction 103 with respect to the spacers 96 by an angle $\beta$ between 0° and 90°, preferably between 45° and 60°.

A bending or, respectively, deflection of the deflection elements 99 with respect to the axis of rotation can likewise provide the streaming, heavy phase a motion component parallel to the axis of rotation. This also is encompassed in the subject matter of the present invention.

The examples explained and illustrated in the figures serve to illustrate the basic function of a control device according to the invention.

Although various minor modifications may be suggested by those versed in the art, it should be understood that wish to embody within the scope of the patent warranted hereon, all such embodiments as reasonably and properly come within the scope of the contribution to the art.

Claimed as the invention:

1. A centrifuge for separating solids/liquids mixtures, comprising: a centrifuge drum having a drum housing as an outer jacket and a rotating body substantially within the drum having separating means associated therewith; aperture means in the jacket for at least partially discharging at least one concentrated solids phase therethrough; at least one control device means connected to the rotating body for periodically opening and closing said aperture means as the rotating body rotates relative to the drum; drive means for rotating the rotating body relative to the drum; and the control device means comprising means for movement past the aperture means in the rotating direction of the rotating body at a given interval in a closing position to effectively block the aperture means for a significant small period of time to prevent discharge at the aperture means, the interval being sufficiently small to prevent any substantial flow through the aperture means.

2. A centrifuge according to claim 1 wherein the control device means is rotatably arranged in relationship to the drum and is connected to the drum via the drive means.

3. A centrifuge according to claim 1 wherein the control device means is operated with a differential speed with respect to the drum.

4. A centrifuge according to claim 1 wherein the drive means includes means for variably setting the differential speed.

5. A centrifuge according to claim 4 wherein said means for variable setting can adjust the differential speed from zero up to a speed of the drum.

6. A centrifuge according to claim 1 wherein the control device means is in effective interaction with the aperture means.

7. A centrifuge according to claim 6 wherein the control device means is designed such that a relative motion is produced with respect to the drum jacket which alternately covers or uncovers the aperture means.

8. A centrifuge according to claim 6 wherein the control device means has a width portion at least partially covering the aperture means.

9. A centrifuge according to claim 1 wherein the control device means is arranged within the drum.

10. A centrifuge according to claim 1 wherein the control device means is arranged outside of the drum.

11. A centrifuge according to claim 1 wherein the control device means has a disk-shaped design.

12. A centrifuge according to claim 1 wherein the control device means comprises a rotary valve.

13. A centrifuge according to claim 1 wherein the control device means is equipped with stripper means for keeping the aperture means clean.

14. A centrifuge according to claim 1 wherein the aperture means is arranged in a nozzle body which can be screwed into the drum jacket from the outside.

15. A centrifuge according to claim 1 wherein the aperture means comprises a nozzle having a width means for varying a cross-section of a flow-through path.

16. A centrifuge according to claim 15 wherein the means for varying comprises an elastic wear-resistant insert in the nozzle.

17. A centrifuge according to claim 1 wherein the drum housing is cylindrically designed.

18. A centrifuge according to claim 1 wherein several control devices and nozzle-like apertures are arranged in distributed fashion on the drum housing.

19. A centrifuge according to claim 18 wherein the control device means controls the nozzle-like apertures independently of one another.

20. A centrifuge according to claim 1 wherein in addition to the control device means a built-in means is also provided for increasing separation effect.

21. A centrifuge for separating solids/liquids mixtures, comprising: a centrifuge drum having a drum housing as an outer jacket; aperture means in the jacket and for at least partially discharging at least one concentrated solids phase therethrough; at least one control device means for opening and closing said aperture means; drive means for moving the control device means relative to the aperture means; the control device means having a disk-shaped design; and the control device means having at least one recess.

22. A centrifuge for separating solids/liquids mixtures, comprising: a centrifuge drum having a drum housing as an outer jacket; aperture means in the jacket and for at least partially discharging at least one concentrated solids phase therethrough; at least one control device means for opening and closing said aperture means; drive means for moving the control device means relative to the aperture means; the control device means having a disk-shaped design; and the control device means having a cam-like projection at a region of the device means interacting with the aperture means.

23. A centrifuge for separating solids/liquids mixtures, comprising: a centrifuge drum having a drum housing as an outer jacket; aperture means in the jacket and for at least partially discharging at least one concentrated solids phase therethrough; at least one control device means for opening and closing said aperture means; drive means for moving the control device means relative to the aperture means; the control device means having a disk-shaped design; and the control device means having a retarding disk which preferably covers the aperture means with an edge portion.

24. A centrifuge according to claim 23 wherein the retarding disk is arranged on a worm body of a discharge worm within the drum and a spiral of the worm passes through a recess of the retarding disk.

25. A centrifuge for separating solids/liquids mixtures, comprising: a centrifuge drum having a drum housing as an outer jacket; aperture means in the jacket and for at least partially discharging at least one concentrated solids phase therethrough; at least one control device means for opening and closing said aperture means; drive means for moving the control device means relative to the aperture means; a worm body with a spiral thereon being positioned within the outer jacket; the aperture means being below a fluid level within the jacket; and the control device means being mounted on the worm.

26. A centrifuge for separating solids/liquids mixtures, comprising: a centrifuge drum having a drum housing as an outer jacket; aperture means in the jacket and for at least partially discharging at least one concentrated solids phase therethrough; at least one control device means for opening and closing said aperture means; drive means for moving the control device means relative to the aperture means; the centrifuge comprising a separator; said jacket of the centrifuge drum comprising a housing of the separator having a rotatable body therein with separator disks; and the control device means being mounted on said rotatable body.

27. A centrifuge for separating solids/liquids mixtures, comprising: a centrifuge drum having a drum housing as an outer jacket; aperture means in the jacket and for at least partially discharging at least one concentrated solids phase therethrough; at least one control device means for opening and closing said aperture means; drive means for moving the control device means relative to the aperture means; in addition to the control device means a built-in means being also provided for increasing separation effect; and said built-in means comprising a dish packet having spacers between individual dishes of the dish packet which exhibit deflection elements projecting beyond ends of the dishes.

28. A centrifuge according to claim 27 wherein ends of the deflection elements are rotated around their center of gravity axes in a rotational direction by an angle alpha ($\alpha$) between 0° and 90°.

29. A centrifuge according to claim 28 wherein the deflection elements are bent down with respect to said spacers by an angle beta ($\beta$) between 0° and 90° in a direction of a stream thereat.

30. A centrifuge for separating solids/liquids mixtures, comprising: a centrifuge drum having an outer jacket; a worm body within the outer jacket; means for driving the worm body and outer jacket at different speeds; aperture means for at least partially discharging concentrated solids phase therethrough; at least one control device means mounted on the worm body for opening and closing said aperture means, said control device means comprising means for movement past said aperture means at a given interval to effectively block the aperture means, said interval being sufficiently small to prevent any substantial flow of solids or liquids from the centrifuge drum.

31. A centrifuge separator for separating solids/liquids mixtures, comprising: an outer housing having aperture means at a periphery thereof; a rotating body within the housing having separator plates thereon; means for driving the body and outer housing at different speeds relative to one another; at least one control device means for opening and closing said aperture means; and said control device means comprising a discontinuous surface passing at a given interval from the aperture means, said interval being of a width sufficiently small to effectively prevent flow of liquids and solids from the separator.

32. A solid bowl worm centrifuge, comprising: means for continuous separation of solids/liquids mixtures as well as mixtures of liquids of varying density or phases that vary in heaviness; said means for continuous separation including a drum jacket and a conveyor worm therein both having a cylindrical shape; means for rotating the conveyor worm relative to the drum jacket; in the drum jacket at a discharge area thereof aperture means for discharge of the solids/liquids mixtures or the heavier phase for mixtures of liquids of varying phase or density; a radial disc arranged on the worm having a peripheral surface extending at a close interval to the aperture means such that the aperture means is effectively closed for discharge of desired material from the aperture; and a recess at the peripheral surface which effectively allows material discharge through the aperture means when the recess is adjacent thereto.

33. A solid bowl worm centrifuge according to claim 32 wherein the aperture means are changeable in size.

34. A solid bowl worm centrifuge according to claim 32 wherein the aperture means are in an active interaction with a mechanically operated control device means for alternately covering or releasing the aperture means in the drum jacket during relative movement of the conveyor worm with respect to the drum jacket.

35. A solid bowl worm centrifuge according to claim 32 wherein the control device means comprise a disk-like ring arranged on the conveyor worm and extending perpendicularly to a rotating axis of the worm.

36. A solid bowl worm centrifuge according to claim 32 wherein the aperture means comprises nozzles.

37. A centrifuge, comprising: means for separating solids/liquids mixtures as well as mixtures of liquids of differing densities and mixtures of phases which vary in heaviness; said means for separating including a rotating jacket and rotating body therein which rotates relative to the jacket; aperture means in the rotating jacket for discharging the heavier phase or density at a discharge region of the centrifuge; and a blocking surface means protruding from the rotating body which opens and closes the aperture means and which, when aligned with the aperture means, is at a given spacing therefrom, the spacing being chosen sufficiently small and a surface area of the blocking surface means being chosen sufficiently large such that the aperture means is effectively closed a significant angle of rotation of the rotating body so as to prevent discharge of the heavier phase or density.

38. A centrifuge according to claim 37 wherein the jacket is of a cylindrical shape.

39. A centrifuge, comprising: means for separating solids/liquids mixtures as well as mixtures of liquids of differing densities and mixtures of phases which vary in heaviness; said means for separating including a rotating jacket and projection means for increasing separation effect; aperture means in the rotating jacket for discharging the heavier phase or density at a discharge region of the centrifuge; said projection comprising a disk package and wherein individual disks project beyond ends of the disks; and the end projecting beyond the edge of the disk being rotated around an axis lying in the plane of rotation of the centrifuge so as to pass near said aperture means and co-act with the same to limit material flow therethrough.

* * * * *